US006431210B1

(12) United States Patent
Lowe et al.

(10) Patent No.: US 6,431,210 B1
(45) Date of Patent: Aug. 13, 2002

(54) INLET UNLOADER VALVE

(75) Inventors: Norman Philip Lowe, Lancashire (GB); Thomas E. Vincent, Charlotte, NC (US)

(73) Assignee: Ingersoll-Rand Company, Woodcliff Lake, NJ (US)

( * ) Notice: Subject to any disclaimer, the term of this patent is extended or adjusted under 35 U.S.C. 154(b) by 0 days.

(21) Appl. No.: 09/818,871

(22) Filed: Mar. 27, 2001

(51) Int. Cl.[7] ..... G05D 16/10
(52) U.S. Cl. ..... 137/599.18; 417/295
(58) Field of Search ..... 137/599.18; 417/295

(56) References Cited

U.S. PATENT DOCUMENTS

| | | | | | |
|---|---|---|---|---|---|
| 153,801 | A | * | 1/1874 | Biggs | 137/599.18 |
| RE14,662 | E | * | 6/1919 | Haight | 137/599.18 |
| 2,173,819 | A | * | 9/1939 | Boldt | 137/115.13 |
| 2,185,473 | A | | 1/1940 | Neeson | |
| 3,788,776 | A | | 1/1974 | Post et al. | |
| 3,801,017 | A | | 4/1974 | Jarzynski | |
| 3,873,239 | A | * | 3/1975 | Jamieson | 417/281 |
| 4,362,475 | A | | 12/1982 | Seitz | |
| 4,396,345 | A | | 8/1983 | Hutchinson | |
| 4,406,589 | A | | 9/1983 | Tsuchida et al. | |
| 4,968,221 | A | * | 11/1990 | Noll | 137/492.5 |
| 5,540,558 | A | | 7/1996 | Harden et al. | |
| 5,730,172 | A | | 3/1998 | Rodell et al. | |
| 5,785,081 | A | | 7/1998 | Krawczyk et al. | |
| 6,026,587 | A | | 2/2000 | Cunkelman et al. | |
| 6,042,344 | A | | 3/2000 | Lifson | |

* cited by examiner

*Primary Examiner*—Stephen M. Hepperle
(74) *Attorney, Agent, or Firm*—Michael Best & Friedrich, LLP

(57) ABSTRACT

An inlet valve for use in a gas compressor, the inlet valve including a piston movable within a housing chamber toward and away from a housing inlet and a valve disc movable with the piston, the valve disc including an aperture for selectively providing air flow from the housing inlet into the chamber, and a flexible member engageable with the valve disc to close the aperture. The inlet valve also includes a valve seat disposed near the housing inlet, and the piston is movable between a first position where the valve disc contacts the valve seat, and a second position where the valve disc is spaced from the valve seat. A spring biases the valve disc toward the valve seat.

20 Claims, 3 Drawing Sheets

INLET UNLOADER VALVE

FIELD OF INVENTION

The present invention relates to gas compressors, and more particularly to inlet control valves for gas compressors.

BACKGROUND OF INVENTION

Inlet control valves are commonly used on gas compressors to regulate compressor capacity. These valves control the capacity by limiting the intake air that enters the compressor. An unloader valve is a valve that loads and unloads the compressor, and is often used as an inlet control valve. An compressor unloader valve is "loaded" when the valve is open and gas can pass through it, and "unloaded" when the valve is closed and blocks the flow of gas into the compressor.

Pneumatic, hydraulic, and electronic methods have been used to open and close unloader valves. Several unloader valves are two-position valves and only have an open position and a closed position. These valves are not able to modulate to positions between these two extremes, and this limited number of settings can reduce the effectiveness of a compressor.

Additionally, pneumatic unloader valves typically use some type of a piston and cylinder configuration to open and close the valve, and can suffer from a "stick/slip" problem between sliding surfaces sealed with O-rings. The initial force necessary to overcome the static friction between the sliding surfaces of the piston and cylinder is often greater than that needed to overcome the sliding force. Therefore, a larger force must be applied to initially move the piston, but once it is moving, the resistive force is not as large and the piston moves too far.

The stick/slip problem is not of great concern for two-position valves because they are only moving between two extreme positions from the open position to the closed position, and do not stop in between. However, this can be a serious problem with modulating valves because it creates erratic piston movement that is segmented, or choppy, not the smooth controlled movement needed for a modulating valve. The piston will generally move past the desired position, and must be brought back to the proper location.

A problem experienced in oil-flooded compressors is backflow of a gas and oil combination through the air inlet. Backflow can take place when a compressor stops while the system is still pressurized. In this situation, the compressor system has a higher pressure than the atmospheric inlet, so the gas and oil mixture can be forced toward the lower pressure and out the inlet. Prior art arrangements seek to solve this problem by utilizing spring loaded check valves that only allow one-directional flow. These additional check valves are effective, but they increase the cost and complexity of a compressor.

Noise reduction also a concern with gas compressors. Some prior art unloader valves allow the internal noise of the compressor to escape through the inlet valve while it is open. Inlet valves that provide a straight path from the air intake to the compressor are relatively loud because there are fewer mechanisms to block noise as it exits through the valve.

Another noise problem for compressors is known as "rotor rumble" in the industry. This condition occurs when the control valve is unloaded and pressure builds up in the compressor system. Compressors generally relieve this pressure by discharging "blowdown" air. In an oil-filled compressor, the blowdown air is an air and oil mixture and can cause contamination if it is discharged into the atmosphere, or into the compressor package. Some compressors solve this problem by piping the blowdown air to discharge into the intake valve downstream from the air intake filter. Since this cavity is at atmospheric pressure, and the blowdown air is at a higher pressure, the blowdown air expands suddenly and produces an undesirable noise.

SUMMARY OF INVENTION

The invention provides an air compressor including a pneumatic modulating inlet unloader valve that does not experience stick/slip, prevents backflow, prevents rotor rumble, and reduces the noise of blowdown air. The inlet unloader valve includes a housing with a main chamber, a housing inlet, and a housing outlet. Air enters the housing through the housing inlet and exits the housing through the housing outlet. A piston chamber is located within the main chamber, and a piston is at least partially disposed in the piston chamber. The piston is movable within the piston chamber toward and away from the housing inlet.

A valve disc is mounted to the piston, and is movable with the piston. A valve seat is disposed near the housing inlet, and the valve disc contacts the valve seat to create a seal and close the inlet valve. The valve disc is mounted around the piston, and a spring biases the piston towards the closed position and holds the valve disc against the valve seat. The inlet valve is closed, or "unloaded" when the valve disc contacts the valve seat, and open, or "loaded", when the valve disc is separated from the valve seat. Preferably, the inlet valve is normally in the closed position.

The valve disc has an aperture and a flexible member that comprise a plate valve. The plate valve selectively provides air flow from the housing inlet into the main chamber, and the flexible member can contact the valve disc to close the apertures. When the pressure within the compressor reverses, the plate valve preferably seals the apertures to prevent backflow.

A piston retainer preferably surrounds a portion of the piston, and is also disposed within the piston chamber. A control cavity is disposed within the piston chamber, and is at least partially defined by the piston, the piston retainer, and the piston chamber. The control cavity preferably creates a space between the piston and the piston retainer in which a pneumatic signal can be injected to separate the piston from the piston retainer. A control port is interconnected to the housing, and a control inlet runs through the control port and is in fluid flow communication with the control cavity. The pneumatic signal passes through the control inlet and into the control cavity.

The pneumatic signal is used to control the position of the piston. The pneumatic signal works against the spring and moves the piston away from the housing inlet. When the piston moves away from the housing inlet, the valve disc moves with it and separates from the valve seat. The inlet valve can preferably be opened, closed, and placed in any position using a pneumatic signal.

Air compressors must often discharge air to relieve internal pressure. The discharged air is commonly called blowdown air, and creates an undesirable noise if it is vented to an area at a lower pressure. The inlet valve preferably has a blowdown port with a silencer interconnected to the housing inlet where the blowdown air can be discharged. Preferably, the blowdown air is drawn back into the compressor through the plate valve, so any oil or contamination in the blowdown air is contained within the compressor system. The silencer has multiple apertures to breakdown the air stream into multiple smaller streams and dissipate the noise often caused by venting the blowdown air.

Figure 2:
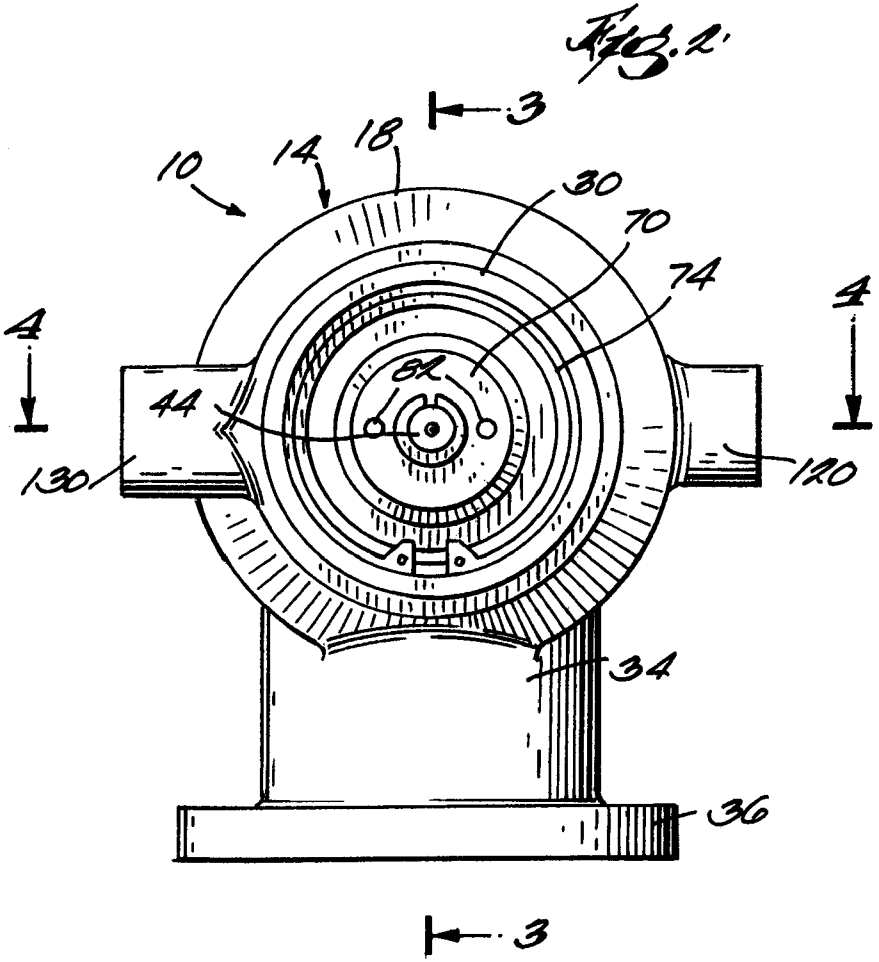
FIG. 2 is a front elevation view of the valve shown if FIG. 1.

Before the embodiments of the invention are explained in detail, it is to be understood that the invention is not limited in its application to the details of construction and the arrangements of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
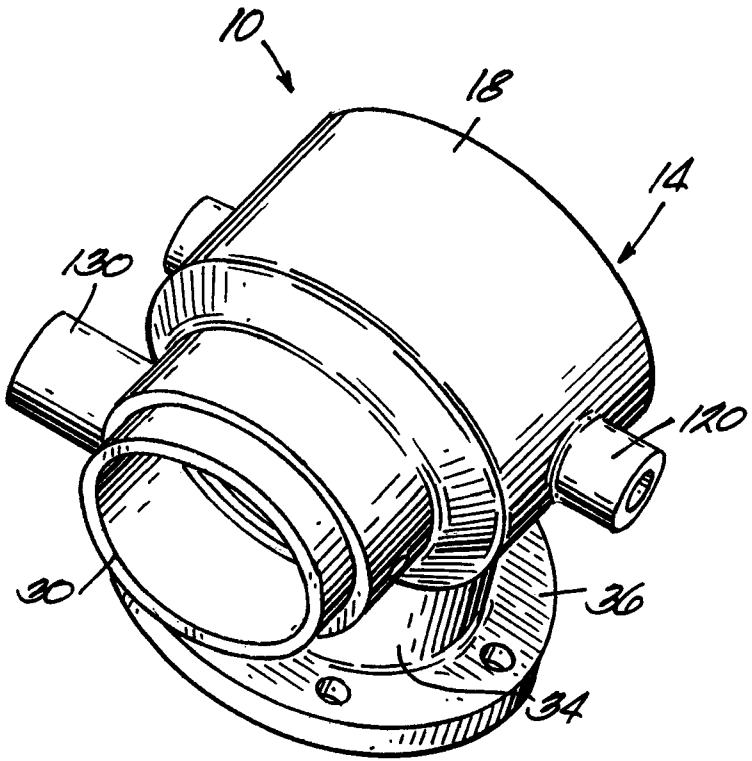
FIG. 1 is a perspective view of an inlet unloader valve embodying the present invention.

FIG. 1 illustrates the exterior of an inlet unloader valve 10 for a gas compressor. The inlet valve 10 has a housing 14 with a main chamber 18, a housing inlet 30, a housing outlet 34, a control port 120, and a blowdown port 124. The gas compressor in the preferred embodiment is an oil-flooded, rotary screw air compressor, but the inlet valve 10 could also be used on other compressors. The inlet valve 10 is preferably interconnected to the compressor, an air intake conduit 32, a control system conduit 122, and a blowdown conduit 126. The inlet valve 10 is intended to regulate the capacity of the compressor.

Figures 3, 4, 5:
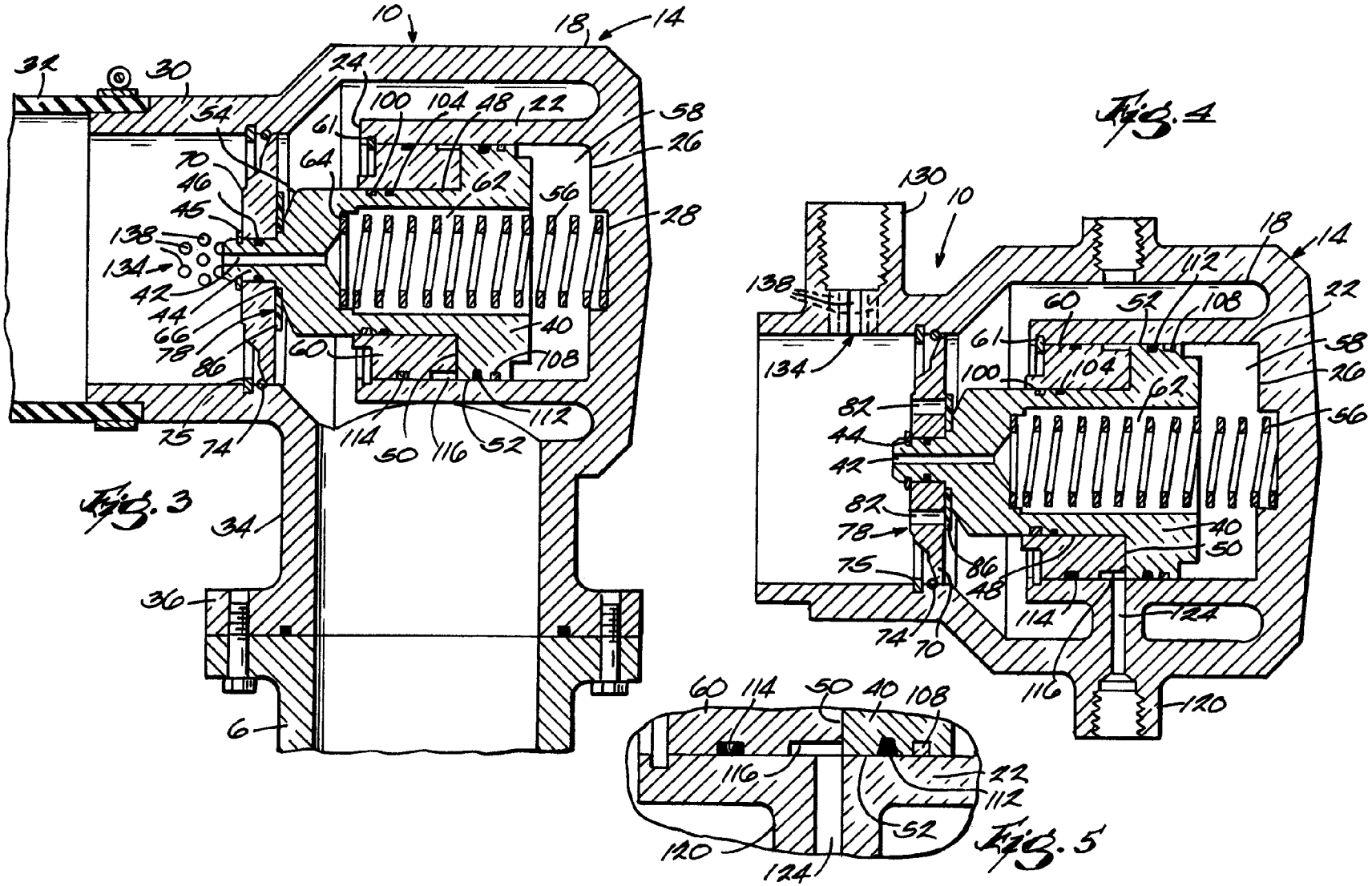
FIG. 3 is a cross-sectional view, taken along line 3—3 of FIG. 2, showing the valve in the closed, or unloaded, position.
FIG. 4 is a cross-sectional view, taken along line 4—4 of FIG. 2.
FIG. 5 is an enlarged view of a portion of FIG. 4.

In the preferred embodiment, various elements of the inlet valve 10 are predominantly circularly or cylindrically shaped. Preferably, the main chamber 18, housing inlet 30, housing outlet 34, control port 120, and blowdown port 130 are all substantially cylindrical. In FIG. 3, the piston chamber 22, piston 40, piston retainer 60, and valve disc 70 preferably have a predominantly cylindrical or circular shape. A cylindrical configuration is not necessary for the invention to function, but cylindrical bodies often have desirable strength characteristics for use in pressure vessels. In the preferred embodiment, the housing inlet 30 and the housing outlet 34 are substantially perpendicular. This angled arrangement reduces the amount of noise from the compressor that travels back through the inlet valve 10 into the atmosphere.

The housing inlet 30 preferably receives air through the housing inlet conduit 32 (FIG. 3). FIG. 2 represents a view looking into the inlet valve 10 through the housing inlet 30, and shows the valve disc 70 disposed near the housing inlet 30. When the inlet valve 10 is closed, the valve disc 70 abuts the valve seat 74 near the end of the housing inlet 30. Also shown in FIG. 2 are the housing outlet 34, the control port 120, and the blowdown port 130. The air that enters the housing 14 through the housing inlet 30 preferably exits through the housing outlet 34 as it passes into the compressor.

In the preferred embodiment, the control port 120 interconnects with the main chamber 18, and the blowdown port 130 is interconnected with the housing inlet 30. The control port 120 and the blowdown port 130 are preferably disposed on opposite sides of the housing 18. However, it is not necessary for the control port 120 and blowdown port 130 to be located at these exact points. The control port 120 could be located radially around the circumference of the main chamber 18, as long as it does not interfere with the housing outlet 34. Likewise, the blowdown port 130 could be relocated radially around the circumference of the housing inlet 30.

FIG. 3 is a cross-sectional view showing the internal components of the inlet valve in the closed position. In the preferred embodiment, the inlet valve 10 is pneumatically modulated and is normally in the closed position. Essentially, the inlet valve 10 uses pneumatic pressure to modulate a piston 40 interconnected to a valve disc 70. A spring 56 preferably acts against a piston 40 that presses a valve disc 70 against a valve seat 74 to maintain the inlet valve 10 in the closed position. To open the inlet valve 10, a pneumatic force preferably moves the piston 40 against the spring 56 and separates the valve disc 70 from the valve seat 74. The operation of the inlet valve 10 will be explained in greater detail below.

The piston chamber 22 is disposed radially inwardly from the main chamber 18, and is preferably cylindrical with one open end 24 and a back surface 26 at the other end. The spring 56 and piston retainer 60 are preferably disposed within the piston chamber 22. The piston 40 is at least partially disposed within the piston chamber 22, and preferably extends through the open end 24 toward the housing inlet 30. The piston 40 preferably has a hollow core 62, and the spring 56 is partially disposed within the core 62. The spring 56 is preferably retained by the piston bore 64 at one end, and the housing bore 28 at the other end.

The piston 40 is preferably a segmented cylinder with a chamber surface 52, a retainer surface 48, a slanted face 54, and a stem 44. The chamber surface 52 is preferably near the end of the piston 40 closest to the back surface 26, the stem 44 is preferably near the end of the piston 40 closest to the housing inlet 30, and the retainer surface 48 is preferably disposed between the chamber surface 52 and the stem 44. The diameter of the piston 40 is the largest at the chamber surface 52. The diameter preferably decreases from the chamber surface 52 to the retainer surface 48, and decreases once again to the stem 44. The slanted face 54 leads from the retainer surface 48 to the stem 44, and is not perpendicular to either of those surfaces.

The spring cavity 58 is disposed within the piston chamber 22 between the piston 40 and the back surface 26, and is in fluid flow communication with the core 62. The piston 40 preferably has a stem vent 42 that extends through the stem 44 and allows the spring cavity 58 to be in fluid flow communication with the housing inlet 30. There is preferably a seal between the chamber surface 52 and the piston chamber 22, so the stem vent 42 prevents pressure from building up in the spring cavity 58 and core 62.

The chamber surface 52 preferably contacts the interior surface of the piston chamber 22. In the preferred embodiment, there is a chamber wear ring 108 and a chamber O-ring 112 along the chamber surface 52. The chamber O-ring 112 preferably creates a seal between the chamber surface 52 and the piston chamber 22. The chamber wear ring 108 preferably facilitates movement and reduces friction between the chamber surface 52 and the piston chamber 22.

The piston retainer 60 is preferably disposed between the piston 40 and the piston chamber 22, and contacts the piston chamber 22 and retainer surface 48. In the preferred embodiment, there is a retainer wear ring 100 and a retainer O-ring 104 along the retainer surface 48. The retainer O-ring 104 preferably creates a seal between the retainer surface 48 and the piston retainer 60. The retainer wear ring 100 preferably facilitates movement and reduces friction between the retainer surface 48 and the piston retainer 60.

In the preferred embodiment, a retainer ring 61 provides support for the piston retainer 60, counteracts the force from the spring 56, and retains the piston retainer 60 and the piston 40 in the proper position while the inlet valve 10 is closed. The retainer ring 61 is preferably an internal circlip. When the inlet valve 10 is in the closed position, the retainer shoulder 50 also preferably contacts the piston retainer 60. The size of the piston retainer 60 is preferably calibrated so that when the retainer shoulder 50 contacts the piston retainer 60, the valve disc 70 also contacts the valve seat 74.

The valve disc 70 is preferably disposed around the stem 44. The piston 40 preferably has a valve shoulder 66 that abuts the valve disc 70 while the inlet valve 10 is closed. A stem O-ring 46 preferably creates a seal between the valve disc 70 and the stem 44, and a stem ring 45 preferably retains the valve disc 70 around the stem 44. In the preferred embodiment, the stem ring 45 is an external circlip. The fit of the valve disc 70 on the stem 44 preferably allows for some angular movement, so the valve disc 70 can self-adjust onto the valve seat 74 and provide a more air-tight seal while the inlet valve 10 is closed.

The valve disc 70 preferably has a plate valve 78 comprised of valve apertures 82 (FIG. 4) and a flexible member 86 to prevent backflow. The flexible member 86 can preferably contact the valve disc 70 to close the plate valve 78, and flex away from the valve disc 70 to open the plate valve 70. The slanted face 54 preferably allows clearance for the flexible member 86 to bend, while the valve shoulder 66 contacts the valve disc 70 to hold it in the closed position.

FIG. 4 is another cross-sectional view of the inlet valve 10, and shows the valve apertures 82 of the plate valve 78. There are two valve apertures 82 in the preferred embodiment, but only one aperture or additional apertures could also be used. The plate valve 78 preferably allows small amounts of make-up air to enter the main chamber while the inlet valve 10 is closed. Since the inlet valve 10 of the preferred embodiment is normally closed, the plate valve 78 and make-up air are of great importance. This makeup air is often necessary to keep a small amount of flow moving through the compressor to maintain the lubrication pressure in the system while the inlet valve 10 is closed. The plate valve 78 is a one-way valve that preferably allows make-up air to enter the compressor, but prevents backflow from exiting the compressor.

When a compressor stops, there is often a pressure reverse back through the inlet. This condition is commonly called backflow, and is undesirable in oil-flooded compressors in which oil is mixed with the air. The backflow of oil could contaminate the air filter or the external environment. The flexible member 86 allows make-up air to flow through the valve disc 70 and into the main chamber 18, but seals the apertures 82 to prevent backflow.

Normally, the pressure in the main chamber 18 is lower than the pressure in the housing inlet 30, so the make-up air flows from the higher pressure housing inlet 30 to the lower pressure main chamber 19. The pressure differential and flow also partially separates the flexible member 86 from the valve disc 70. When the pressure reverses and the main chamber 18 has a higher pressure than the housing inlet 30, the flexible member 86 contacts the valve disc 70 and preferably seals the valve apertures 82 preventing backflow oil from exiting the compressor. The plate valve 78 also preferably prevents excessive reverse rotation of the compressor when it is shut down.

FIG. 4 also illustrates the blowdown port 130 interconnected to the housing inlet 30. Compressors must often relieve pressure within the system when they unload, and this is commonly done by discharging blowdown air. The blowdown air usually contains oil, and is often discharged back into the compressor package to reduce contamination to the outside environment. One solution is to pipe the discharged blowdown air into the intake of the inlet valve. In the preferred embodiment, the blowdown port 130 is interconnected to the housing inlet 30, just upstream from the valve disc 70. At this location, the oil from the blowdown air is preferably drawn back into the compressor through the plate valve 78 because of the flow of make-up air through the plate valve 78 under normal conditions. This allows the blowdown air to relieve pressure from within the system while containing the contaminated oil and air mixture.

One problem with discharging the blowdown air into the air intake is excessive noise. The air in the housing inlet 30 is generally at atmospheric pressure, and the blowdown air comes from within the system and is at a relatively higher pressure. When the higher pressure blowdown air enters the lower pressure air intake in most compressors, it expands suddenly and produces an undesirable noise. In the preferred embodiment, the inlet valve 10 has a built-in silencer 134 in the blowdown port 130 that reduces this noise. The blowdown air in most compressors enters the air intake in a single stream. In the preferred embodiment, the silencer 134 breaks the air stream into several smaller streams to reduce the noise created by the blowdown air. The silencer 134 preferably has multiple silencer apertures 138 to divide the air stream. FIG. 3 illustrates seven silencer apertures 138, however the silencer 134 could include any number of apertures 138 that sufficiently reduce the noise created by the blowdown air.

FIG. 4 illustrates the control port 120 interconnected to the housing 14. The control port 120 preferably has a control inlet 124 that extends through the main housing 18 and piston chamber 22 and is in fluid flow communication with the control cavity 116. The control cavity 116 is preferably disposed within the piston chamber 22, and is at least partially defined by the piston chamber 22, the piston retainer 60, and the piston 40. Preferably, a pneumatic signal enters the control cavity 116 and controls whether the inlet valve 10 is open or closed. A sensor preferably reads the pressure at a certain location, and based on that pressure, a controller determines the desired position for the inlet valve 10. The controller preferably increases a pneumatic signal to the control cavity 116 to open the inlet valve 10, or reduces the signal to close the inlet valve 10.

In the preferred embodiment, a spring 56 preferably acts against a piston 40 that is connected to a valve disc 70 to maintain the inlet valve 10 in the closed position. FIG. 4 illustrates the inlet valve 10 in the closed, or "unloaded" position. The valve disc 70 abuts the valve seat 74 to form a seal and preferably prevent air from entering the main chamber 18. To open the valve 10, a pneumatic signal enters the control cavity 116 and forces the piston 40 against the spring 56 and away from the housing inlet 30. The movement of the piston 40 separates the valve disc 70 from the valve seat 74, and allows air to enter the main chamber 18 from the housing inlet 30. The compressor is "loaded" when the valve disc 70 is separated from the valve seat 74.

FIG. 5 is an enlarged view of the control cavity 116 and the control inlet 124. The piston 40 preferably contacts the piston retainer 60 when the inlet valve 10 is closed. A pneumatic signal preferably flows through the control inlet 124 and into the control cavity 116 to separate the retainer shoulder 50 from the piston retainer 60. FIG. 5 also shows the chamber O-ring 112 and chamber wear ring 108 along the chamber surface 52, and preferably contacting the piston chamber 22.

Preferably, the piston chamber 22 in FIG. 4 is fixed and the piston retainer 60 is restricted by the retainer ring 61, but the piston 40 is capable of movement. Therefore, the position of the piston 40 can preferably be controlled by altering the pressure in the control cavity 116. As mentioned above, the spring 56 preferably biases the piston 40 towards the closed position depicted in FIGS. 3 and 4. Increasing the pressure in the control cavity 116 can preferably move the piston 40 generally towards the back surface 26 and open the inlet valve 10, as shown in FIG. 6.

Figure 6:
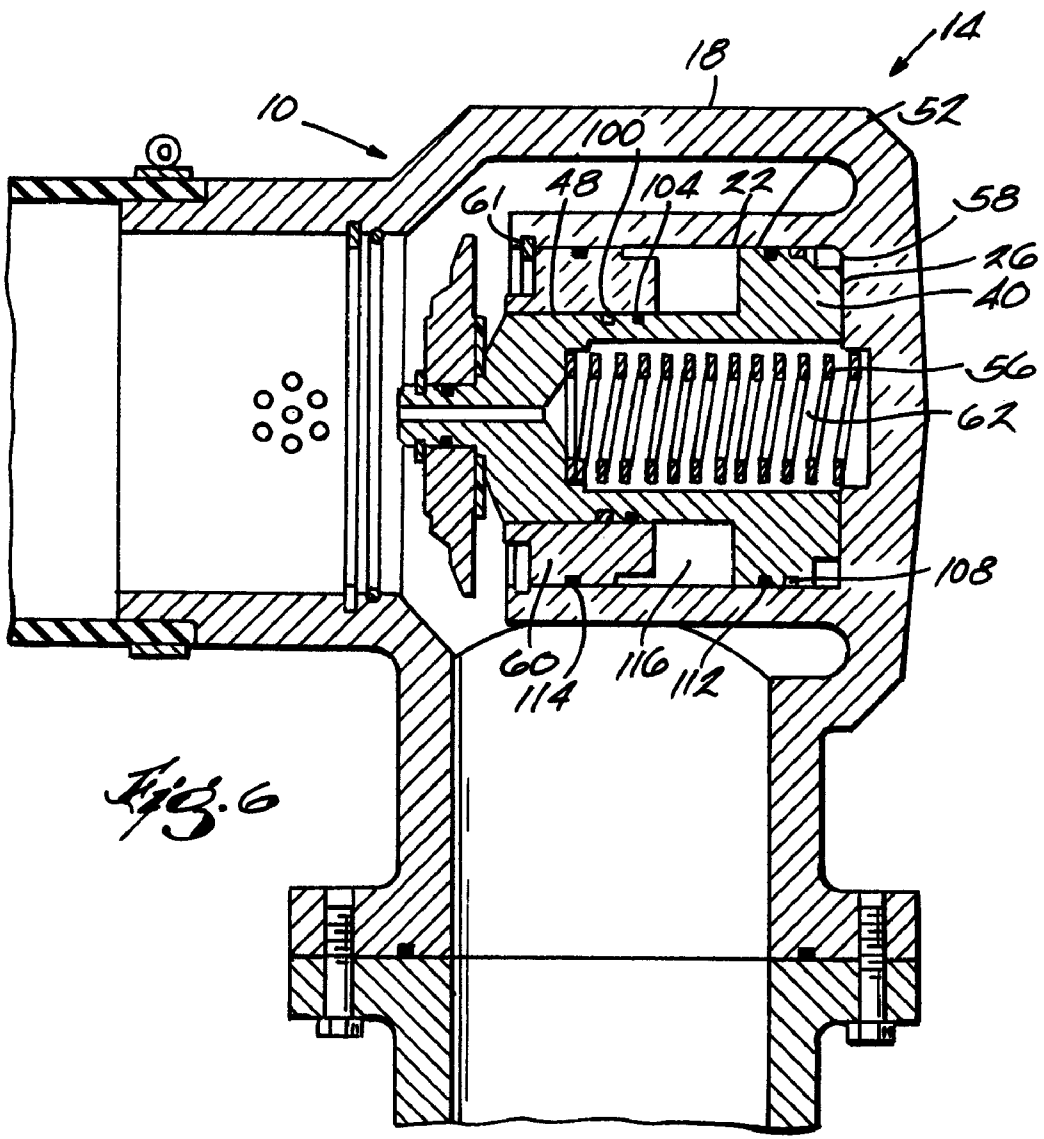
FIG. 6 is a view similar to FIG. 3, but showing the valve in the open, or loaded, position.

FIG. 6 illustrates a cross-sectional view showing the internal components of the inlet valve 10 in an open, or "loaded" position. The inlet valve 10 is completely open with the piston 40 contacting the back surface 26. While FIGS. 3 and 6 illustrate the inlet valve 10 in the extreme positions, it is capable of modulating the piston 40 to any position between the closed position of FIG. 3 and the closed position depicted in FIG. 6. A modulating inlet valve 10 allows the compressor to operate more efficiently. When the inlet valve 10 is opened, the volume of the control cavity 116 increases, and the volume of the spring cavity 58 decreases. The spring cavity 58 in FIG. 3 is larger than the spring cavity 58 in FIG. 6, and the control cavity 116 in FIG. 6 is larger than the control cavity in FIG. 3.

As illustrated in FIG. 4, the stem vent 42 preferably allows the core 62 and spring cavity 58 to be in fluid flow communication with the housing inlet 30. With this arrangement, the piston 40 and pneumatic signal in the control cavity 116 do not have to work against air pressure as well as the spring 56. The air in the spring cavity 56 that is displaced when the piston 40 moves can exit through the stem vent 42. The spring 56 is preferably calibrated to provide a predetermined amount of resistance which the pneumatic signal can counteract and position the piston 40 in the desired location.

A common problem for valves utilizing sliding surfaces sealed with O-rings is a "stick/slip" phenomena. In the preferred embodiment, the inlet valve 10 must have a sealed cavity to use a pneumatic control. The piston 40 preferably has a chamber O-ring 112 to create a seal between the chamber surface 52 and the piston chamber 22, and a retainer O-ring to create a seal between the retainer surface 48 and the piston retainer 60. There is also an auxiliary O-ring 114 between the piston retainer 60 and the piston chamber 22. These O-rings 104, 112, 114 preferably seal the control cavity 116. Preferably, the chamber surface 52 slides relative to the piston chamber 22, and the retainer surface 48 slides relative to the piston retainer 60. The "stick/slip" phenomena would normally be a problem for most valves, but the inlet valve 10 preferably has wear rings that substantially eliminate the problem.

The "stick/slip" problem can occur when an O-ring seals sliding surfaces and the initial force needed to overcome static friction is greater than the sliding friction force. The O-ring is normally mounted to one surface, but then may stick to the other surface to creates a friction force between the surfaces. The force required to overcome the initial friction force may be greater than the resistive sliding forces between the surfaces. Therefore a relatively large force must be applied to initially move one of the surfaces, but once the surface moves the resistive sliding friction force is much less than the applied force.

This phenomena makes moving the surfaces relatively difficult because the surface will generally over-shoot the desired location because of the immediate decrease in resistance. This commonly results in erratic, choppy or segmented movement. This problem is not as significant with two-position valves because they are only going between extreme positions of open and closed and generally can not over-shoot these positions. However, this problem is of much greater concern for modulating valves that require relatively precise movement. In the preferred embodiment, wear rings overcome the "stick/slip" problem.

In the preferred embodiment, there are wear rings 100, 108 that accompany the O-rings 104, 112. There is preferably a chamber wear ring 108 around the chamber surface 52 adjacent the chamber O-ring 112, and a retainer wear ring 100 around the retainer surface 48 adjacent the retainer O-ring 104. The wear rings 100, 108 preferably smooth the movement of the piston 40 and offer improved abrasion qualities to extend the life of the inlet valve 10. The static friction force is reduced by the wear rings 100, 108 and the O-rings 104, 112 are preferably prevented from sticking to the opposite surface. A wear ring is not necessary for the auxiliary O-ring 114 because the piston retainer 60 normally does not slide relative to the piston chamber 22.

What is claimed:

1. A gas compressor inlet valve comprising:

a housing having a chamber, a housing inlet for receiving gas, and a housing outlet through which gas is discharged;

a piston movable within said chamber toward and away from said housing inlet;

a valve disc movable with the piston, said valve disc including an aperture through said valve disc and selectively providing air flow from the housing inlet into the chamber, and a flexible member engageable with said valve disc to close said aperture;

a valve seat disposed near said housing inlet, said piston movable between a first position where said valve disc contacts said valve seat, and a second position where said valve disc is spaced from said valve seat;

a spring biasing said valve disc toward said valve seat.

2. The valve of claim 1, wherein said valve disc includes at least one plate valve in said valve disc, wherein said plate valve includes said aperture and said flexible member.

3. The valve of claim 1, wherein said housing inlet is substantially perpendicular to said housing outlet.

4. A gas compressor inlet valve comprising:

a housing having a chamber, a housing inlet for receiving gas, and a housing outlet through which gas is discharged;

a piston movable within said chamber toward and away from said housing inlet;

a valve disc movable with the piston, said valve disc including an aperture through said valve disc and selectively providing air flow from the housing inlet into the chamber, and a flexible member engageable with said valve disc to close said aperture;

a blowdown port having a silencer.

5. The valve of claim 4, wherein said piston has a stem, and said valve disc surrounds said stem.

6. The valve of claim 4, wherein said valve disc includes at least one plate valve in said valve disc, wherein said plate valve includes said aperture and said flexible member.

7. The valve of claim 4, wherein said silencer consists of multiple apertures.

8. The valve of claim 4, wherein said blowdown port is disposed upstream from said valve disc.

9. The valve of claim 4, wherein said blowdown port is in fluid flow communication with said housing inlet.

10. A gas compressor inlet valve comprising:

a housing having a chamber, a housing inlet for receiving gas, and a housing outlet through which gas is discharged;

a piston movable within said chamber toward and away from said housing inlet;

a valve disc movable with the piston, said valve disc including an aperture through said valve disc and selectively providing air flow from the housing inlet into the chamber, and a flexible member engageable with said valve disc to close said aperture;

a control cavity disposed within said piston chamber, and at least partially defined by said piston;

a control port interconnected to said housing, and in fluid flow communication with said control cavity.

11. The valve of claim 10, wherein said piston has a stem, and said valve disc surrounds said stem.

12. The valve of claim 10, wherein said valve disc includes at least one plate valve in said valve disc, wherein said plate valve includes said aperture and said flexible member.

13. The valve of claim 10, wherein said chamber includes a main chamber and a piston chamber, and further comprising, a piston retainer disposed within said piston chamber, wherein said control cavity is at least partially defined by said piston chamber and said piston retainer.

14. A gas compressor inlet valve comprising:

a housing having a chamber, a housing inlet for receiving gas, and a housing outlet through which gas is discharged;

a piston movable within said chamber toward and away from said housing inlet;

a valve disc movable with the piston, said valve disc including an aperture through said valve disc and selectively providing air flow from the housing inlet into the chamber, and a flexible member engageable with said valve disc to close said aperture;

a piston retainer disposed within said piston chamber, wherein said piston retainer encircles at least a portion of said piston, and wherein said piston has a retainer surface that contacts said piston retainer, and a chamber surface that contacts said piston chamber;

a retainer wear ring disposed along said retainer surface;

a chamber wear ring disposed along said chamber surface.

15. The valve of claim 14, wherein said valve disc includes at least one plate valve in said valve disc, wherein said plate valve includes said aperture and said flexible member.

16. The valve of claim 14, further comprising a retainer O-ring disposed along said retainer surface.

17. The valve of claim 14, further comprising a chamber O-ring disposed along said chamber surface.

18. A gas compressor inlet valve comprising:

a housing having a chamber, a housing inlet for receiving gas, and a housing outlet through which gas is discharged;

a piston movable within said chamber toward and away from said housing inlet;

a valve disc movable with the piston;

a valve seat disposed near said housing inlet, said piston movable between a first position where said valve disc contacts said valve seat, and a second position where said valve disc is spaced from said valve seat;

a spring biasing said valve disc toward said valve seat;

a blowdown port interconnected to said housing inlet, said blowdown port having a silencer;

a control cavity disposed within said piston chamber, and at least partially defined by said piston;

a control port interconnected to said housing, and in fluid flow communication with said control cavity;

a piston chamber disposed within said chamber;

a piston retainer disposed within said piston chamber, wherein said control cavity is at least partially defined by said piston chamber and said piston retainer, and wherein said piston retainer surrounds at least a portion of said piston, and wherein said piston has a retainer surface that contacts said piston retainer, and a chamber surface that contacts said piston chamber;

a retainer wear ring disposed along said retainer surface;

a chamber wear ring disposed along said chamber surface.

19. The valve of claim 18, wherein said silencer consists of multiple apertures.

20. The valve of claim 18, further comprising:

a retainer O-ring disposed along said retainer surface;

a chamber O-ring disposed along said chamber surface.

* * * * *